United States Patent [19]

Villamagna et al.

[11] Patent Number: 4,689,096

[45] Date of Patent: Aug. 25, 1987

[54] EXPLOSIVE BOOSTER COMPOSITION

[75] Inventors: Fortunato Villamagna, St. Leonard; Howard A. Bampfield, Otterburn Park, both of Canada

[73] Assignee: C-I-L Inc., North York, Canada

[21] Appl. No.: 23,680

[22] Filed: Mar. 9, 1987

[30] Foreign Application Priority Data

Apr. 28, 1986 [CA] Canada ..... 507794

[51] Int. Cl.[4] ..... C06B 45/00

[52] U.S. Cl. ..... 149/2; 149/21; 149/41; 149/43; 149/44; 149/60; 149/61; 149/109.6

[58] Field of Search ..... 149/109.6, 2, 21, 41, 149/43, 44, 60, 61

[56] References Cited

U.S. PATENT DOCUMENTS

| | | | |
|---|---|---|---|
| 4,600,450 | 7/1986 | Jessop et al. | 149/92 |
| 4,600,451 | 7/1986 | Jessop et al. | 149/92 |
| 4,600,452 | 7/1986 | Jessop et al. | 149/92 |
| 4,632,714 | 12/1986 | Abegg et al. | 149/2 |

*Primary Examiner*—Stephen J. Lechert, Jr.
*Attorney, Agent, or Firm*—Donald G. Ballantyne

[57] ABSTRACT

A packaged booster charge is provided which is sensitive to initiation by blasting cap yet which contains no self-explosive ingredient. The composition of the booster comprises a low melting point nitrate salt or salt mixture having dissolved or finely dispersed therein an acetylenic substance and void containing material. The booster is safe and economic to manufacture and sufficiently powerful to initiate insensitive blasting agents.

8 Claims, No Drawings

EXPLOSIVE BOOSTER COMPOSITION

BACKGROUND OF THE INVENTION

1. Field of the Invention

This invention relates generally to explosives and more particularly, to booster charges for detonating relatively insensitive blasting agents.

2. Description of the Prior Art

Relatively insensitive blasting agents, such as those of the ammonium nitrate/fuel oil (ANFO) type or the water gel slurry type, have found widespread commercial use. These blasting agents are characterized by an inability to be detonated by a commercial No. 8 blasting cap and require boostering to initiate detonation. Explosive boosters are compact explosive charges which are sensitive to blasting cap or detonating cord initiation and which provide sufficient energy to detonate a main charge of insensitive blasting agent.

Various booster compositions and designs are described in the prior art. See, for example, U.S. Pat. No. 3,037,452 and U.S. Pat. No. 3,037,453 to M. A. Cook et al.; U.S. Pat. No. 3,359,902 to J. J. Minnick; U.S. Pat. No. 3,371,606 to M.A. Cook; U.S. Pat. No. 3,604,354 to R. A. Brown et al.; U.S. Pat. No. 3,880,080 to M. A. Cook; U.S. Pat. No. 4,009,060 to H. F. Bluhm; U.S. Pat. No. 4,161,142 to D. W. Edwards et al.; U.S. Pat. No. 4,331,081 to J. A. R. Cloutier et al.; U.S. Pat. No. 4,385,948 to R. Reed et al.; U.S. Pat. No. 4,394, 197 to J. Kubik et al. Nearly all of the aforementioned inventions employ a cast charge of self-explosives or a dispersion of a self explosive in a formable matrix. The self-explosives used are generally trinitrotoluene, cyclotrimethylenetrinitramine, pentaerythritrol tetranitrate and the like. These self-explosives are inherently hazardous, especially when melted for casting and, in addition, are costly. The booster of U.S. Pat. No. 4,161,142 which contains no self-explosive, consists of a selected blend of ammonium nitrate particles and liquid fuel densely packed in a rigid package. This booster, however, lacks sensitivity and requires initiation by a small self-explosive cast primer charge. There remains a need for a booster charge which is safe to manufacture and transport, economic to produce, sufficiently powerful to initiate insensitive blasting agents yet sensitive to blasting cap or detonating cord initiation.

SUMMARY OF THE PRESENT INVENTION

Accordingly, an object of the present invention is to provide a novel explosive booster composition. A further object is to provide a booster charge which is cap-sensitive yet is devoid of any self-explosive. Yet another object is to provide a booster charge which is economic and safe to manufacture and is reliable in use.

These and other objects of the invention are accomplished by providing an explosive booster composition comprising a low melting point nitrate salt or a mixture of nitrate salts, the said nitrate salt or salt mixture being capable of remaining molten at temperatures below 120° C., and the said salt or salt mixture while molten having dissolved or finely dispersed therein a fuel/sensitizer which is an acetylenic substance and having also dispersed therein void-containing material. The low melting nitrate salt or salts from which selection may be made comprise the freely commercially available ammonium, calcium, sodium, lithium and potassium nitrates. Other less commonly available nitrate salts may be chosen but there is generally no economic or technical advantage in so doing. The acetylenic fuel /sensitizer is, preferably, 1,4-butynediol. The butynediol is readily commercially available but it and many other active acetylenic compounds, useful in this context, may be easily prepared by reacting acetylene with simple aldehydes or ketones. Thus, the reaction of formaldehyde with acetylene can give propargyl alcohol or butynediol whereas reaction with acetone can give 3-methyl-3-hydroxy butyne. The oxidation products of these alcohols such as propiolic acid and acetylene dicarboxylic acid are also active in sensitizing the compositions and may easily be prepared by direct oxidation of the alcohols. It has been surprisingly found that butynediol and a range of similar simple inexpensive acetylenic compounds are fully soluble and/or easily dispersible in molten mixtures of ammonium and metal nitrate salts. The employment of such acetylenic substances as fuel/sensitizers thus provides a most favourable degree of intimate association of the essential fuel component and the essential oxidizer component in an explosive composition and simultaneously provides increased sensitivity to explosive initiation. The preferred void-containing material is glass microspheres or finely divided perlite.

DESCRIPTION OF THE PREFERRED EMBODIMENT

The explosive booster composition of the present invention comprises one or more molten inorganic oxidizer salts having dissolved therein an acetylenic fuel/-sensitizer, together with dispersed particulate void-containing material. The inorganic oxidizer salt mixture preferably comprises about one part ammonium nitrate and from two to three parts of one or more other inorganic salts which lower the melting point of the ammonium nitrate. The preferred other inorganic salts, because of ready availability and low cost, are sodium nitrate and calcium nitrate. It is known, for example, that pure ammonium nitrate has a melting point of 170° C. When mixed with 27% by weight of sodium nitrate, the melting point of the ammonium nitrate/sodium nitrate mixture is reduced to 120° C. Similarly, a blend of about one part ammonium nitrate and about two parts of commercial grade calcium nitrate shows a melting point range of from 90° C to 50° C. Generally, the choice of the second inorganic salt or salts to be used in admixture with ammonium nitrate will be based on cost and on the formation of suitably safe and low melting points ranging from about 40° C to about 120° C. These reduced melting temperatures allow for the incorporation of the acetylenic fuel/sensitizer material and the particulate void-containing material at safe, convenient, workable temperatures before solidification or thickening of the melt occurs. Where a nitrate salt has a sufficiently low melting point such as, for example, calcium nitrate, such a salt may be used alone as the oxidizer component.

As noted heretofore, the preferred acetylenic fuel/-sensitizer is 1,4-butynediol, $HOCH_2C{\equiv}CCH_2OH$. Other acetylenic alcohol fuel/sensitizers may also be employed, for example propargyl alcohol, $HC{\equiv}CCH_2OH$, 2-butyn-1-ol, $CH_3C{=}CCH_2OH$ and 3-methyl-1-butyn-3-ol, $(CH_3)_2COHC{\equiv}CH$.

The oxidation products of these alcohols which retain their acetylenic content also show fuel/sensitizing properties. Examples of these oxidation products are the carboxylic acids such as propiolic acid $HC{\equiv}C$-

COOH and acetylene dicarboxylic acid HOOCC≡C-COOH and the aldehydes and ketones corresponding to the primary and secondary alcohols above.

The void-containing materials are, preferably, hollow glass spheres available, for example, from 3M Company under the designations C15/250, B23/500 or B28/750 or particulate perlite, for example, "GT-23 MICROPERL" (Reg. TM) from Grefco Inc.

If desired, other useful ingredients, such as, for example, finely divided aluminum or ferrosilicon may be incorporated in the explosive booster composition of the invention as part replacement for the acetylenic fuel/sensitizer.

When employed, such metal powders will normally comprise not more than about 50% by weight of the fuel/sensitizer component.

A small proportion of a thickener such as guar flour may also be usefully incorporated.

The ratio by weight of the salt or salt mixture to acetylenic fuel/sensitizer in the explosive of the invention is, preferably, of the order of 4:1 although compositions containing as little as 10% by weight of the fuel/-sensitizer have been found to be cap-sensitive. Amounts of fuel/ sensitizer in excess of about 20% by weight show no noticeable improvement in the sensitivity of the booster composition.

The amount of void-containing material added should be such to achieve a density of from 1.10 to 1.30 g/ml. Densities in excess of about 1.45 g/ml failed to demonstrate cap-sensitivity. However, compositions having densities in the range of from 1.30 to 1.50 g/ml were sensitive to initiation by a small, 20 gm primer charge of PETN. At densities lower than about 1.10 g/ml, no improvement in sensitive was observed. The preferred range of densities for the booster of the invention is between 1.20 and 1.25 g/ml.

The novel explosive booster composition of the invention is prepared by heating a nitrate salt or salt mixture to a temperature of about 100° C. or slightly higher until the salt or salt mixture forms a melt. The melt is then cooled to about 50° C. and the acetylenic fuel/sensitizer is added, with agitation to the salt melt. The composition is stirred for about five minutes at 50° C. and thereafter agitation is continued to provide cooling at which time the particulate void-containing material is added. The composition may, then be extruded or poured into containers, for example, spiral-wound paper shells, where it is allowed to cool and thicken.

The invention may be more fully understood be reference to the following Example and Tables.

EXAMPLE I

An explosive booster composition containing the proportions of ingredients shown in Table I, below, was made as follows.

The ammonium nitrate, sodium nitrate and calcium nitrate in particulate form were dry blended and then heated to a temperature of about 100° C. until the salts became molten. This salt melt was then allowed to cool to and maintained at a temperature of 50° C. The acetylenic alcohol fuel/sensitizer, 1,4-butynediol was added to the salt melt with stirring over a period of five minutes. Thereafter, the glass microballoons and guar thickening agent were added and stirring continued for an additional five minutes and the composition was poured into rigid, 50 mm diameter wound paper shells where it cooled and thickened.

the result shown in Table 1, below, demonstrates the detonability of the booster explosive of the invention.

TABLE 1

| Ingredients | |
|---|---|
| AN (uncoated) | 23.4% |
| SN (synthetic) | 3.1% |
| CN (commercial - Norsk) | 52.9% |
| 1,4-Butynediol | 17.3% |
| Thickeners (guar) | 0.4% |
| Microballoons (class) | 2.9% |
| Min. primer | EB |
| VOD (km/s)* | 4.1 |
| Density (g/ml) | 1.20 |
| Diameter (mm) | 50 |

*50 mm diameter

EXAMPLE II

Compositions made in the manner described in Example I were prepared using one part ammonium nitrate and two parts calcium nitrate as the oxidizer salt mixture.

The resultant properties are shown in Table II, below.

TABLE II

| Effect on Removal of SN | |
|---|---|
| Ingredients | |
| AN (coated) | 26.5% |
| CN (commercial - Norsk) | 52.9% |
| 1,4-Butynediol | 17.9% |
| Thickeners (guar) | 0.40% |
| Microballoons (glass) | 2.9% |
| Min. primer | R16 |
| VOD (km/s)* | 3.9 |
| Density (g/ml) | 1.18 |
| Diameter (mm) | 50 |

*50 mm diameter

EXAMPLE III

Compositions similar to those of Example II were made using various ratios ammonium nitrate to calcium nitrate.

The results are shown in Table III, below.

TABLE III

| Effect of AN/CN Ratio | | | | | | | | |
|---|---|---|---|---|---|---|---|---|
| Sample No. | % 1,4-butynediol | % AN | % CN | %·Guar | % μB* | Min. Prim. | VOD** (km/s) | Density (g/ml) |
| 1 | 17.3 | 0 | 79.6 | 0.2 | 2.9 | INSOLUBLE | | |
| 2 | 17.3 | 19.6 | 60.0 | 0.2 | 2.9 | EB | 3.8 | 1.20 |
| 3 | 17.3 | 39.1 | 40.3 | 0.2 | 2.9 | 40 g | 3.5 | 1.18 |
| 4 | 17.3 | 48.9 | 30.5 | 0.2 | 2.9 | EB | 3.9 | 1.14 |
| 5 | 17.3 | 58.7 | 20.7 | 0.2 | 2.9 | EB | 3.7 | 1.15 |
| 6 | 17.3 | 79.6 | 0 | 0.2 | 2.9 | CRYSTALLIZED | | |

*glass microspheres
**50 mm diameter

EXAMPLE IV

Compositions similar to those of Example II were made wherein the density of the final product was varied by employing increasing amounts of glass microspheres.

The results are shown in Table IV, below.

TABLE IV

| Sample No. | % 1,4-Butynediol | % AN | % CN | % Guar | % μB* | Density (g/ml) | Min. Prim. | VOD** (km/s) |
|---|---|---|---|---|---|---|---|---|
| | | | Effect of Density | | | | | |
| 1 | 17.8 | 40.3 | 41.5 | 0.2 | 0 | 1.60 | — | — |
| 2 | 17.8 | 39.9 | 41.3 | 0.2 | 0.5 | 1.49 | 20 g | — |
| 3 | 17.7 | 39.9 | 40.1 | 0.2 | 1.0 | 1.42 | A3 | 3.2 |
| 4 | 17.6 | 39.7 | 40.9 | 0 2 | 1.5 | 1.30 | EB | 3.4 |
| 5 | 17.5 | 39.6 | 40.9 | 0.2 | 1.7 | 1.22 | EB | 3.8 |
| 6 | 17.4 | 39.5 | 40.7 | 0.2 | 2.0 | 1.12 | R8 | 4.0 |

*glass microspheres
**50 mm diameter

EXAMPLE V

Composition similar to those of Example II were made wherein the quantity of 1,4-butynediol fuel/sensitizer employed was varied.

The results are shown in Table V, below.

TABLE V

| Sample No. | % 1,4-Butynediol | % AN | % CN | % Guar | % μB | Density (g/ml) | Min. Prim. | VOD (km/s) |
|---|---|---|---|---|---|---|---|---|
| | | | Effect of Butynediol | | | | | |
| 1 | 8.0 | 44.1 | 44.8 | 0.2 | 2.9 | 1.17 | A3 | 3.7 |
| 2 | 9.5 | 43.4 | 44.1 | 0.2 | 2.8 | 1.20 | EB | 3.0 |
| 3 | 10.2 | 43.0 | 43.8 | 0.2 | 2.8 | 1.19 | EB | 3.6 |
| 4 | 11.4 | 42.5 | 43.1 | 0.2 | 2.8 | 1.19 | EB | 3.9 |

EXAMPLE VI

A series of compositions were made in the manner described in Example I wherein the fuel/sensitizer was selected from a variety of nitrate salts. The compositions were subjected to detonation tests, the results being shown in Table VI, below.

TABLE VI

| Sample No. | % CN (Norsk) | % SN | % AN | % $LiNO_3$ | % $KNO_3$ | % Butynediol | % Guar | % μB | Density (g/ml) | Min. Prim. |
|---|---|---|---|---|---|---|---|---|---|---|
| 1* | 76.6 | | | | | 20 | 0.2 | 3.2 | 1.11 | EB |
| 2 | 38.4 | 38.4 | | | | 20 | 0.2 | 3.0 | 1.15 | EB |
| 3* | | 38.4 | 38.4 | | | 20 | 0.2 | 3.0 | 1.16 | EB (marginal) |
| 4 | 38.4 | | | 38.4 | | 20 | 0.2 | 3.0 | 1.15 | EB |
| 5 | 38.4 | | | | 38.4 | 20 | 0.2 | 3.0 | 1.15 | EB |
| 6** | | | 38.4 | 38.4 | | 20 | 0.2 | 3.0 | 1.15 | EB (marginal) |

*Sample detonated 15 minutes after preparation. Crystallization and separation noticed several hours after preparation.
**Sample contained some undissolved butynediol at mix temperature.

EXAMPLE VII

To demonstrate the utility of the explosive composition of the invention as a booster, 200 gram samples of the composition shown in Table II were prepared and were used to initiate charges of cap-insensitive water-in-oil emulsion explosives at a density of 1.29 g/ml in 75 mm diameter cartridges. The booster was initiated by means of an electric blasting cap. The cartridged emulsion explosive charge was detonated three times out of three with an average velocity of denotation of 4.8 km/s.

EXAMPLE VIII

To demonstrate the sensitivity of the explosive composition of the invention to initiation by means of detonating cord, samples of the composition of Table II were prepared in 50 mm diameter cartridges, 200 mm long. A length of detonating cord containing 10 g/m of PETN was placed in linear contact with about a 100 mm length of each cartridge and the detonating cord was initiated by means of and electric blasting cap. The cartridges detonated three times out of three.

EXAMPLE IX

A composition comprising 17.9% by weight of 1,4-butynediol, 26.3% ammonium nitrate, 52% calcium nitrate, 0.2% guar and 3.6% perlite (DICAPERL HP-200 (Reg. TM) was prepared at a density of 1.19 g/ml and cartridged in 50 mm diameter paper cartridges. When initiated by means of an electric blasting cap, all cartridges detonated at a velocity of detonation of 4.3 km/s.

EXAMPLE X

A base composition comprising 17.9% by weight of 1,4-butynediol, 26.5% ammonium nitrate, 52.3% calcium nitrate, 0.2% guar and 3.1% glass microballoons was prepared. This base composition was modified by replacing a portion of the 1,4-butynediol with various amounts of finely divided aluminum and ferrosilicon. The effect of the use of metal powders is shown in Table VII below.

TABLE VII

| 1,4-Butynediol | Al | | Fe/Si | |
|---|---|---|---|---|
| Replaced by metal | Density | Min. Primer/VOD | Density | Min. Primer/VOD |
| 10 | 1.21 | R10/4.9 | 1.20 | R8/4.8 |
| 25 | 1.20 | R6/3.8 | 1.20 | R8/4.0 |
| 50 | 1.24 | R10/3.8 | 1.25 | R11/3.7 |
| 75* | — | — | 1.25 | R11 |

*Severe crystallization took place after about 15 minutes with Al sample, and 30 minutes with Fe/Si sample.

The appearance of the compositions of the invention ranges from light tan to brown in colour, depending on the amount of CN and acetylenic diol present in the system. When freshly prepared, the compositions have a feel and viscosity similar to a partially cross-linked water gel. After about one days storage, some crystal growth takes place, and the mixture hardens to the consistency of bread dough. Since the formulations have no inherent water resistance, the preferred method of packaging is in plastic containers.

Further thickening and enhanced water resistance can be obtained through use of larger amounts of guar and crosslinkers such as potassium pyroantimonate as is commonly practised with regular slurry explosives.

The sensitizing effects of the fuel/sensitizers is not limited to the alcohols. For example, the oxidation products of propargyl and butynediol, respectively, propiolic acid (HC≡CCOOH) and acetylene dicarboxylic acid (HOOCC≡COOH) show similar sensitizing effect to their "parent" alcohols. Table VII below shows examples.

This behaviour of the acetylenic materials may be contrasted with that of the structurally similar ethylenic and saturated alcohols. Thus, compositions made with butene-1,4-diol in place of the butynediol showed greatly reduced sensitivity to initiation and reduced velocity of detonation. Compositions made with the saturated alcohol butane-1,4-diol are insensitive even to quite powerful booster charges. Details of these tests are listed in Table VIII below.

TABLE VIII

| Acetylenic Derivative (A.D.) | Booster Compositions % AD | % AN | % CN | % SN | % Guar | % μB | ρ (g/ml) | Detonation Test |
|---|---|---|---|---|---|---|---|---|
| Propargyl alcohol | 17.9 | 26.5 | 52.3 | 0 | 0.40 | 2.9 | 1.15 | EB-D |
| 3-Methyl-3-hydroxy-butyne* | 17.9 | 26.5 | 52.3 | 0 | 0.40 | 2.9 | 1.15 | EB-D |
| Propiolic acid | 17.9 | 26.5 | 52.3 | 0 | 0.40 | 2.9 | 1.15 | EB-D |
| Acetylene dicarboxylic acid | 17.9 | 26.5 | 52.3 | 0 | 0.40 | 2.9 | 1.15 | EB-D |
| 2-Butyn-1-ol | 17.9 | 26.5 | 52.3 | 0 | 0.40 | 2.9 | 1.15 | EB-D |
| Butyn-1,4-diol | 17.3 | 23.4 | 52.9 | 3.1 | 0.40 | 2.9 | 1.20 | EB-D (VOD 4.1 50 mm) |
| Butene-1,4-diol | 17.3 | 23.4 | 52.9 | 3.1 | 0.40 | 2.9 | 1.20 | 20 g-D (VOD 2.0 50 mm) |
| Butane-1,4-diol | 17.3 | 23.4 | 52.9 | 3.1 | 0.40 | 2.9 | 1.20 | 40 g-F |

*This substance was of limited dispersibility in the molten salt: use of 1% surfactant (Dispersal SPEA) was required to obtain explosive performance.

It is postulated that the endothermic nature of the acetylenic alcohols together with their ability to mix intimately with the molten salt mixture creates the observed sensitizing effects. This postulation is further supported by the retained performance shown by the acetylenic acids which have reduced fuel value (because of their partially oxidized nature) but not reduced sensitivity.

It will be clear, therefore, to those skilled in the explosives art, that other acetylenic or polyacetylenic derivatives carrying a sufficient number of polar groups so as to be readily soluble or dispersible in the nitrate salt premix will show similar explosive performance to the compositions exemplified herein.

It should be appreciated that the oxidizers salt constituents of the explosive compositions herein described and exemplified are in the form of their commercial products and, as such, may contain varying amounts of water. The melt mixtures, therefore, might be expected to contain as much as 8% by weight of water. It will also be understood by those skilled in the art that the novel disclosed explosive compositions may, if desired, also contain other non-essential, enhancing ingredients to modify the consistency of explosive strength of the final product. Such non-essential ingredients include, for example, solubilizing agents and energetic salts, such as, chlorates and perchlorates.

We claim:

1. An explosive composition comprising:

(a) one or more nitrate salts which are capable of remaining molten at temperatures below 120° C.;

(b) at least one organic compound having the formula XC↑CY wherein X and Y are the same or different and are selected from the group consisting of $$H,\ R_1R_2\underset{\underset{OH}{|}}{C}-,\ R_1\underset{\underset{O}{\|}}{C}-\ \text{and}\ HO\underset{\underset{O}{\|}}{C}-$$

wherein $R_1$ and $R_2$ are selected from H and lower alkyl containing up to four carbon atoms, provided that when X is H, Y is selected from $$R_1R_2\underset{\underset{OH}{|}}{C}-,\ R_1\underset{\underset{O}{\|}}{C}-\ \text{and}\ HO\underset{\underset{O}{\|}}{C}-$$

wherein $R_1$ and $R_2$ are as above; and (c) a void containing, density lowering material dispersed in said composition.

2. An explosive composition comprising:

(a) one or more nitrate salts which are capable of remaining molten at temperatures below 120° C.;

(b) at least one organic compound selected from the group having the formula

XC≡CY wherein X and Y are the same or different and are selected from the group consisting of

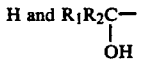

wherein $R_1$ and $R_2$ are selected from H and methyl, provided that when X is H, Y is

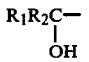

and (c) a void containing, density lowering material dispersed in said composition.

3. An explosive composition as claimed in Claim 2 wherein the said organic compound contains up to two saturated carbon atoms in each molecule in addition to the acetylenic and alcohol groups.

4. An explosive composition as claimed in Claim 1 also containing a thickening agent.

5. An explosive composition as claimed in Claim 1 in the form of a booster charge.

6. An explosive composition as claimed in Claim 1 comprising from 65 to 90% by weight of a nitrate salt or nitrate salt mixture, from 10 to 30% by weight of organic compound and up to 5% by weigh of void containing material.

7. A method of preparing explosive compositions which comprises:

(a) heating one or more nitrates salts to a molten state at a temperature not exceeding 120° C. with agitation;

(b) cooling said molten salt or salt mixture to a lowest temperature at which it remains fluid enough for easy mixing with other ingredients;

(c) adding to said molten salt or salt mixture and blending therein an organic compound as claimed in Claim 1 together with optional thickeners, cross-linkers and additional metallic fuel; and (d) casting the composition so prepared in moulds.

8. An explosive composition comprising from 20 to 25% ammonium nitrate, up to 5% sodium nitrate, from 45 to 60% calcium nitrate, from 10 to 25% 1,4-butynediol, from 0 to 1% thickening agent, up to 5% microballoons and from 0 to 10% particulate fuel in the form of finely divided aluminum or ferrosilicon.

* * * * *